US005224677A

United States Patent [19]

Close

[11] Patent Number: 5,224,677

[45] Date of Patent: Jul. 6, 1993

[54] PULL DOWN DISPLAY AND STORAGE APPARATUS

[75] Inventor: James G. Close, Malakoff, Tex.

[73] Assignee: Hoyt-Close Products, Inc., Lafayette, La.

[21] Appl. No.: 609,817

[22] Filed: Nov. 6, 1990

Related U.S. Application Data

[63] Continuation-in-part of Ser. No. 485,153, Feb. 23, 1990, Pat. No. 5,058,846.

[51] Int. Cl.[5] ..... E04G 3/00

[52] U.S. Cl. ..... 248/292.1; 248/585; 312/247; 312/325; 211/104; 211/201

[58] Field of Search ..... 248/284, 292.1, 293, 248/585; 312/247, 266, 325; 211/104, 118, 201

[56] References Cited

U.S. PATENT DOCUMENTS

| | | | |
|---|---|---|---|
| 264,748 | 9/1882 | Potts | 312/266 X |
| 2,634,188 | 4/1953 | Davis | 312/247 |
| 2,822,229 | 2/1958 | Carlson | 248/284 |
| 2,938,631 | 5/1960 | Brey | 248/284 |
| 3,172,632 | 3/1965 | Borg | 248/284 |
| 3,417,953 | 12/1968 | Hillquist et al. | 248/284 |
| 3,490,727 | 1/1970 | Miller | 248/284 |
| 3,586,324 | 6/1971 | Bearson | 248/284 X |
| 3,667,714 | 6/1972 | Ziaylek, Jr. | 248/284 |
| 4,076,351 | 2/1978 | Wyant | 312/247 |
| 4,330,101 | 5/1982 | Anderson | 248/284 |
| 4,946,652 | 8/1990 | Dewald et al. | 248/284 |
| 5,014,953 | 5/1991 | Warnan et al. | 248/284 |
| 5,031,867 | 7/1991 | Cotterill | 248/284 |
| 5,037,054 | 8/1991 | McConnell | 248/284 |
| 5,108,063 | 4/1992 | Koerber, Sr. et al. | 248/284 |

FOREIGN PATENT DOCUMENTS

| | | | |
|---|---|---|---|
| 576890 | 6/1976 | Switzerland | 248/284 |

*Primary Examiner*—Peter M. Cuomo
*Assistant Examiner*—Michael Milano
*Attorney, Agent, or Firm*—Pravel, Hewitt, Kimball & Krieger

[57] ABSTRACT

A pull down display and storage device in one aspect has a member movable with respect to a fixed support having pivot apparatus interconnected between the fixed support and the movable member, the movable member moving out and down from the fixed support, and in one aspect a spring or springs and/or a dampener controlling motion of the movable member and permitting balanced movement of the movable member or of the movable member and a load thereon; in one aspect, the device including the fixed support; and in another aspect, the device being releasably locked in a downward position due to the disposition of the pivot apparatus and spring. A support, shelf or case with one or more such devices.

4 Claims, 6 Drawing Sheets

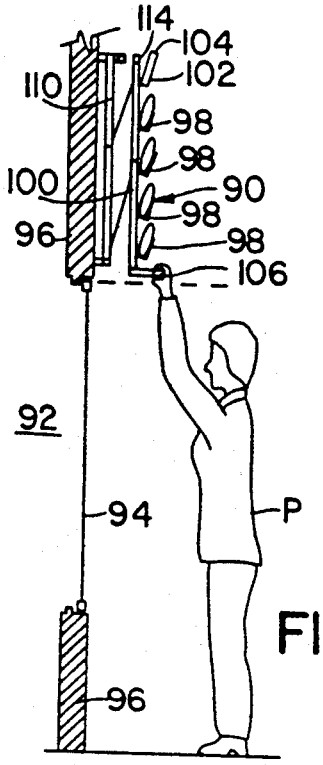
FIG. 10a
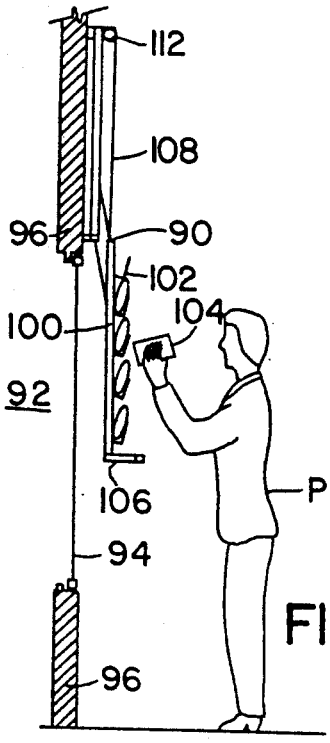
FIG. 10b
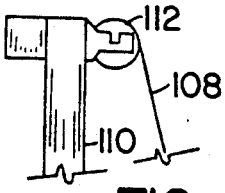
FIG. 11a
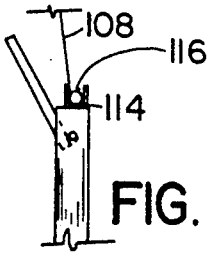
FIG. 11b
FIG. 12a
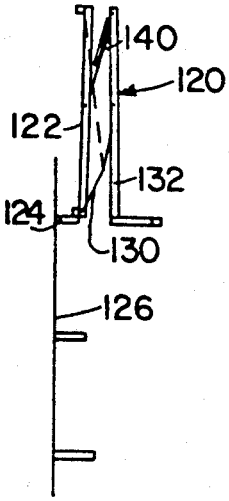
FIG. 12b
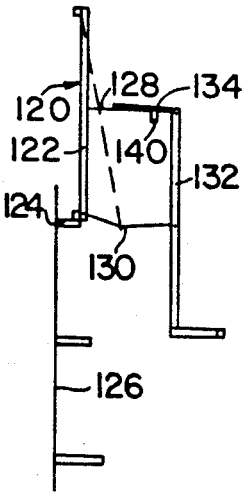
FIG. 12c
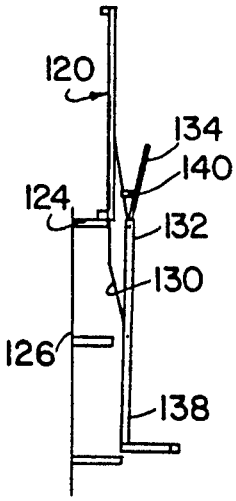

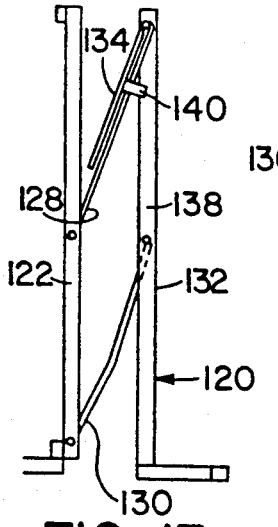
FIG. 13
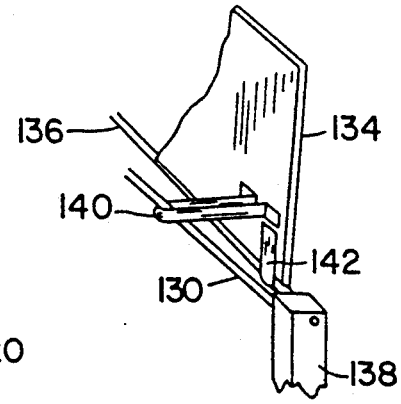
FIG. 14
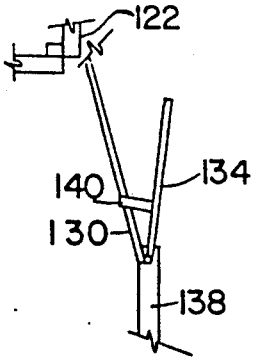
FIG. 15
FIG. 17b
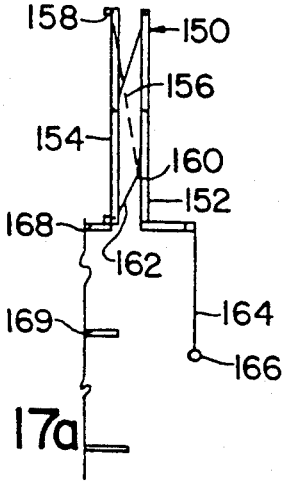
FIG. 17a
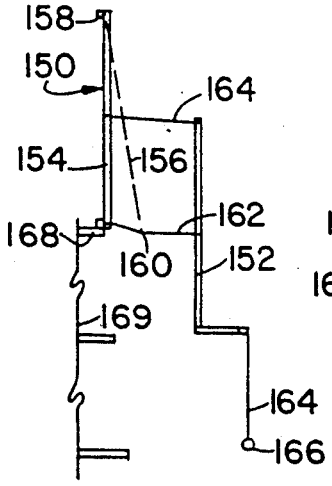
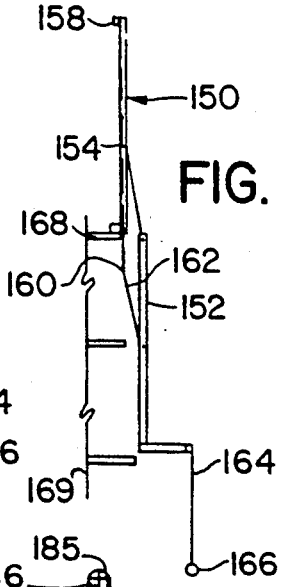
FIG. 17c
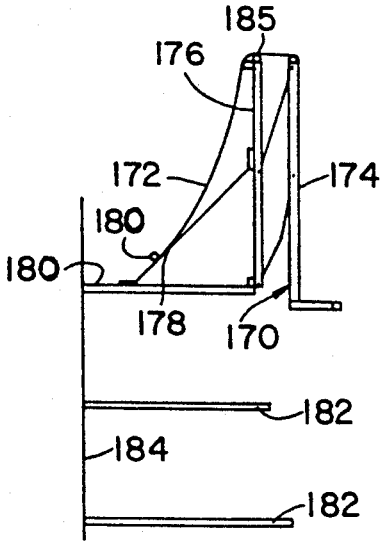
FIG. 18a
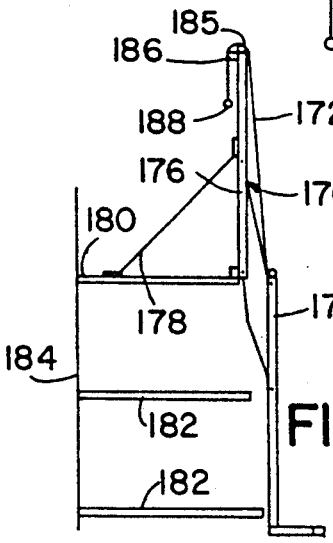
FIG. 18b

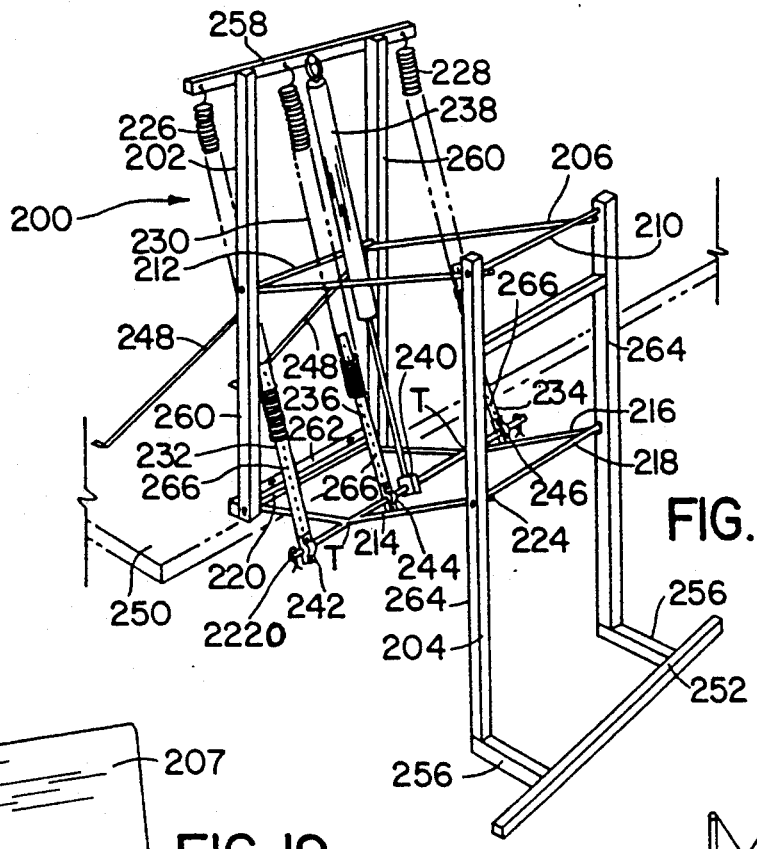
FIG. 16
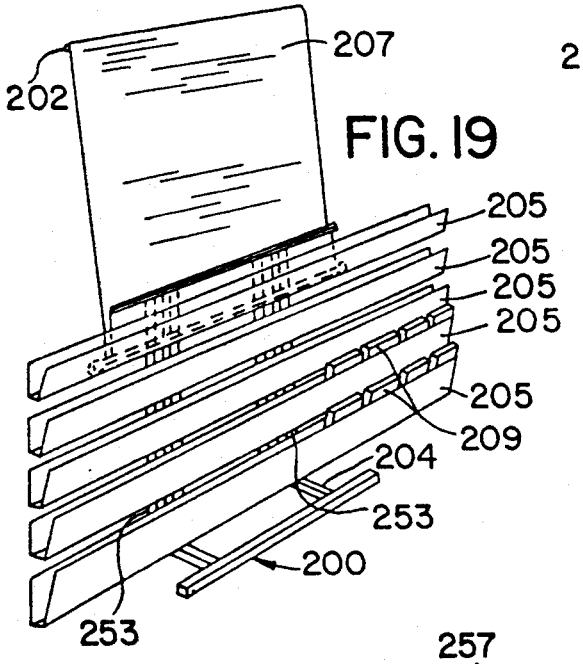
FIG. 19
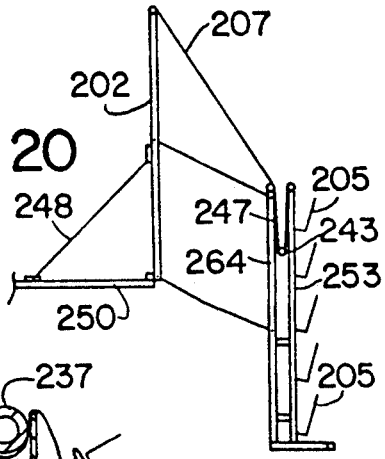
FIG. 20
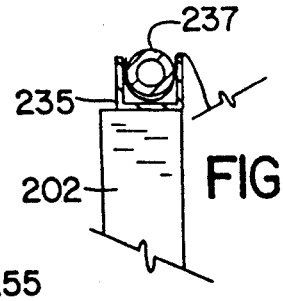
FIG. 21
FIG. 22
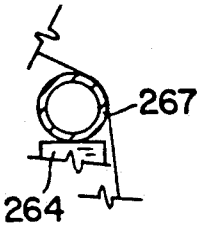
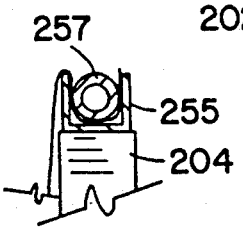
FIG. 23
FIG. 24
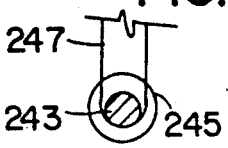

PULL DOWN DISPLAY AND STORAGE APPARATUS

CROSS REFERENCE TO RELATED APPLICATION

This application is a continuation-in-part of application Ser. No. 07/485,153 filed on Feb. 23, 1990, now U.S. Pat. No. 5,058,846.

BACKGROUND OF THE INVENTION

1. Field Of The Invention

This invention relates to the field of display and storage apparatus. In particular, it is an apparatus and method for displaying and storing items at an elevated height which can be pulled down to a convenient height to remove the items from the apparatus. In one aspect, this invention is directed to a support or a shelf with a movable display device and in another aspect to a merchandise case with a movable display device.

2. Description of Related Art

New products for the consumer and competing brands of the same product are constantly being developed. One of the chief problems facing retail stores is finding the shelf space to display these items for sale to customers. For example, grocery store space is allocated to competing vendors and producers. Vendors are constantly fighting for more shelf space. This shortage of shelf space makes it difficult to display new products and forces vendors to cannibalize a portion of their allocated space simply to display new products. Because of their small size, convenience stores face this problem to a greater degree than grocery stores.

In most retail stores, all available floor and display space has been utilized to the fullest extent. Items are displayed as high as an average customer can reach. This usually means products are displayed from the floor to a height of about six feet above the floor. Products displayed at a greater height are impossible to reach. In modern "warehouse stores," items are displayed to a height of about seven feet and cannot be reached by short customers. The space above seven feet is used to store similar items in stacks.

If it can be shoehorned into an existing store, additional display space costs the retailer an insignificant amount of money. Overhead in terms of rent, utilities and labor remains practically the same, but the number and type of items that can be displayed and sold increases, increasing sales per square foot of store. A retailer can save significant amounts of energy and money in a smaller store with the same display and shelving footage as a larger store. One solution which may offer additional display space is a set of shelves hanging from a ceiling, such as that disclosed in U.S. Pat. No. 4,295,432.

There has long been a need for something that makes possible the efficient and effective utilization of unused space in stores and warehouses. There has long been a need for something which gives everyone access to items positioned above a normal height and gives certain persons, e.g. those in wheelchairs, access to items which they otherwise could not reach. There has long been a need for such things which do not require great physical strength to operate.

SUMMARY OF THE INVENTION

The invention, in one aspect, is a movable frame for connection to and movement with respect to a fixed support. The movable frame may be comprised of multiple elements including a movable frame member, a pivot means, a spring means, a dampening means, and a support means. The combination of the movable frame, the pivot means and a fixed support form the preferred invention embodiment of a pull down display and storage apparatus.

The pivot means is interconnected between the movable frame member and the fixed support for combined pivoting movement of the frame member from a first position adjacent the fixed support to a second position outwardly from and downwardly with respect to the fixed support. The preferred pivot means comprises upper and lower pivot arms which are pivotally coupled to the fixed support and the movable frame member. The upper and lower pivot arms support the movable frame member and permit the movable frame to swing vertically downward from a first retracted position adjacent the fixed support to an extended position below the fixed support and to return to said retracted position.

The optional spring means is interconnected between the movable frame member and the fixed support. The spring means biases the movable frame in a retracted position by pulling the movable frame member toward the fixed support as the movable frame member moves outwardly and downwardly from the fixed support.

The invention also includes a method for moving products from an initial raised position to a final lower position by the step of pulling down on a movable frame, when the movable frame is comprised of the elements discussed herein.

In one embodiment, a pull-down display according to the present invention is free-standing and includes a support or pedestal which holds the pull-down display at a desired height; e.g. the support or pedestal can be of such a height that the pull-down display is disposed above the normal height of individuals or above the usual height of stored or displayed goods. The support or pedestal may include more than one pull-down display as well as one or more shelves disposed beneath the pull down display.

In another embodiment of the present invention, a merchandise or food case or container is provided which has a support for items or for food (fresh, packaged, cold, or frozen) with one or more pull-down displays secured to a part of the case above its contents.

A pull-down display according to the present invention (and supports, shelves, and cases according to the present invention) have a variety of advantages, including but not limited to the feature that, in one embodiment, the movable part will remain either up or down, i.e., a middle position will not be maintained; the device can accommodate items of different weights and can be adjusted to handle different items; since it is relatively thin and compact, such a device can be positioned easily in numerous locations in a store or warehouse, particularly in previously unused and/or inaccessible space; and by suitable adjustment of and use of springs or similar members, a loaded display can be gently lifted.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions or further improvements.

BRIEF DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

FIGS. 10*a* and 10*b* are side views of a pull-down display according to the present invention.

FIGS. 11*a* and 11*b* are partial side views of a device according to the present invention.

FIGS. 12*a*, 12*b* and 12*c* are side views of a device according to the present invention.

FIG. 13 is a side view of the device of FIG. 12*a*.

FIGS. 14 and 15 are partial perspective side views of the device of FIGS. 12*a*.

FIG. 16 is a perspective view of a device according to the present invention.

FIGS. 17*a*, 17*b* and 17*c* are side views of a device according to the present invention.

FIGS. 18*a* and 18*b* are side views of a device according to the present invention.

FIG. 19 is a perspective view of a device according to the present invention.

FIG. 20 is a side view of the device of FIG. 19.

FIGS. 21–24 are partial side views of the device of FIG. 20.

Figure 1:
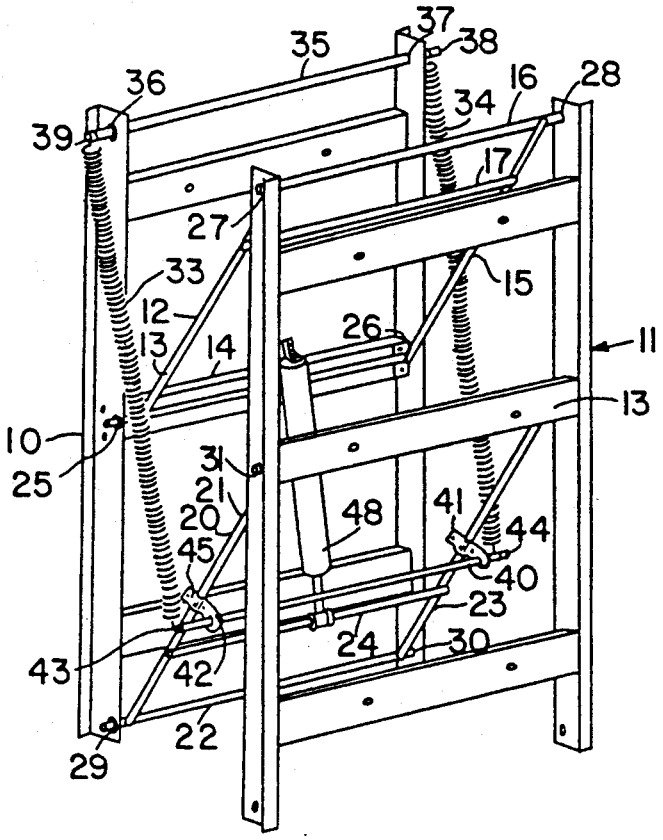
FIG. 1 is an isometric drawing of a pull down display and storage apparatus according to this invention.

DETAILED DESCRIPTION OF EMBODIMENTS PREFERRED AT THE TIME OF FILING FOR THIS PATENT

A shelf at eye level is the best display space in any store. It catches a shopper's attention and is easy to reach. Unfortunately, a retail store has too little eye level space. In most stores, the only space available is above six feet and out of reach for all but the tallest of shoppers. The preferred pull down display and storage apparatus of the present invention allows the space above six feet to be utilized in a retail environment for the display and sale of products in an attractive fashion. With the instant invention, it is a simple matter for even a five-foot tall shopper to pull the unit down to chest and eye level, remove a product, and start the unit on its upward course to its retracted position. With just a start by the customer, the preferred unit automatically returns to this original raised position.

Although the pull down apparatus may be dimensioned to most any size, the preferred apparatus is sized to about 47 and 35 inches overall width to allow for ease of installation in conjunction with the modular 48 and 36 inch shelving and gondolas common to the retail industry. A height of about 30 to 36 inches overall is also preferred. These overall dimensions of a display support means can be easily mounted on a movable frame about 10 to 20 inches or more in width. Of course, smaller or greater dimensions are also useful.

Placing rows of the pull down display and storage apparatus above existing wall shelving, gondolas and refrigerated displays may add twenty percent or more display space to a retail store. For example, a small grocery store with ten gondolas 50 feet long, 400 feet of refrigerated display, and 200 feet of wall shelving could add 4000 usable square feet of display face with peg board on the pull down apparatus. Above 100 feet of refrigerated display, 250 square feet of space (enough to accommodate 1000 individually displayed videotapes) could be added. Above 1000 feet of gondolas, 5000 square feet of peg board items could be displayed.

Of course, display fronts can be varied to accommodate varying merchandise. Possibilities include peg board, shelves, cups, troughs, or other displays.

In addition to the obvious retail store applications, the pull down apparatus is desirable for numerous storage uses. It is ideal for storing odds and ends in the typically cluttered home garage, or for storing spices, cooking needs, and glasses in restaurants and home kitchens. Small items can be easily stored within reach of workers in factories. The list goes on and on.

The movable frame invention which is the core of the pull down display and storage apparatus is comprised of several elements. The movable frame interacts with a fixed support by connection of a movable frame member to and movement of that member relative to the fixed support by a pivot means. The pivot means provides for movement of the movable frame from a first retracted position adjacent the fixed support to and past a second position and to a third position near the fixed support during continued downward movement. The movable frame may also be comprised of other elements including a spring means, a dampening means, and a support means for supporting and displaying products on the movable frame.

As used herein, the terms "movable frame" and "pull down display and storage apparatus" are not synonymous. But it should be recognized that statements about the "movable frame" also describe and apply to the "pull down apparatus." Likewise, statements about the pull down apparatus also describe and apply to the movable frame. The only exceptions are the uses to which the movable frame may be placed and the fact that the pull down apparatus may or may not include a fixed support.

The fixed support is a stationary support. It may be part of or be mounted to a well, ceiling, floor, or shelving unit. The movable frame upon which products are displayed and stored is supported by the fixed support preferably through upper and lower pivot arms. The fixed support for the pull down apparatus in a retail setting may be attached to standard height extensions commonly available to increase the height of modular gondolas and shelving units.

The upper pivot arm has two ends, one end pivotally coupled to the fixed support relatively near a middle of the fixed support and the other end pivotally coupled to the movable frame member relatively near a top of the movable frame member. The lower pivot arm has two ends, one end pivotally coupled to the fixed support relatively near a bottom of the fixed support and the other end pivotally coupled to the movable frame member relatively near a middle of the movable frame member. The pivot arms support the movable frame member and permit it to swing vertically downward from a first retracted position adjacent the fixed support to an extended position below the fixed support and to return to the retracted position.

A spring means interconnected between the movable frame member and the fixed support biases the movable frame member in the first retracted position. The spring means initially pulls the movable frame member toward the fixed support as the member moves outwardly from the fixed support and pulls the member upwardly as the member moves downwardly with respect to the fixed support. Depending on the particular design of the movable frame apparatus, the spring means may also pull the movable frame member toward the fixed support as the member approaches the limit of its downward travel below the fixed support.

The spring means has two ends, preferably one end attached to the fixed support and the other end attached to the movable frame member, or most preferably, the lower pivot arm. In some designs, attachment could be made to the upper pivot arm. The attachment to the fixed support should be at a point vertically higher than the spring means attachment point to the movable frame or pivot means when the movable frame rests in the retracted position.

Preferably, the spring means is attached relatively near a top of the fixed support. More preferably, the spring means is attached to a horizontal rod mounted to the fixed support relatively near a top thereof.

A screw means to change the tension of the spring means is also desirable. This would permit the use of different product loads on the movable frame without physically changing the spring means. One would merely turn a screw to stretch or loosen the spring means and change the force that the spring means exerts against the load on the movable frame.

The spring means tension may also be changed by substituting a new spring means or adding additional spring means to the apparatus. Although two springs, one on each side of the apparatus, provide the preferred spring means, additional springs on each side can be added to increase the tension of the spring means.

It may be desirable to adjust the spring tension so that a maximum pull down pressure of ten pounds is required at the maximum point. This would allow for a product load of one pound, five pounds or up to ten pounds on the movable frame member without any adjustment required. In this example, the product load could vary by as much as ten pounds of products.

This ten pound load example is an extreme since the apparatus will often be used for blister packs or other light products. But it should be noted that the apparatus is not simply a load pulling down on a spring, such as the system used in single or double sash windows, which require an exact balance of weight and spring tension.

In a preferred embodiment, the spring means is attached to an offset pivot arm extension, which is itself attached to the lower pivot arm. This offset extension of the pivot arm is located between the lower pivot arm and movable frame member when the movable frame member is in the retracted position, and when the movable frame member is in its extended position, the lower pivot arm is located between the offset extension and the movable frame member. Please see FIGS. 3 and 4. The offset pivot arm extension is preferably a rod extending to each side of the lower pivot arm.

The purpose of the offset extension is to lock the movable frame member in the extended position automatically. In all positions of the movable frame except the fully extended position, the spring means will pull on the lower pivot arm and the movable frame member urging the movable frame member into its upward retracted position. But because of the offset attachment of the spring means to the lower pivot arm, there will be a vertical alignment position near the extended position where the point of attachment of the spring means to the offset extension is directly below and aligned with the pivotally coupling point attaching the lower pivot arm to the fixed support and the upper point of attachment of the spring means to the fixed support.

Urging the movable frame member past this vertical alignment position to its fully extended position will cause the point of attachment of the spring means to the offset extension to move past this vertical alignment with the lower pivot arm and spring means attachment point to the fixed support so that the pull of the spring means will urge the movable frame member in a downward extended position. To return the movable frame member to its upward retracted position, all that is required is to move the movable frame member a short distance in its downward position away from the fixed support to move the offset extension point of attachment past the vertical alignment position to a position between the movable frame member and the point of attachment of the lower pivot arm to the fixed support. Once the vertical alignment position has been passed, the spring means will automatically return the movable frame member to this upward retracted position.

The most preferred offset pivot arm extension is a rod attached to the lower pivot arm by brackets which maintain the offset rod a set distance away from the lower pivot arm. Preferably, the position of the brackets may be varied along the length of the lower pivot arm. The movement of the offset rod along the pivot arm provides a way to adjust the tension of the spring means. Of course, other offset extensions may be attached to the pivot arm instead of a rod.

In one embodiment, the spring means are two springs attached to the ends of the offset rod. A plastic coating or tubing may be used to encase the ends of the offset rod to anchor the springs in place (the springs will dig into the coating) and to silence the noise of the springs rubbing on the offset rod.

The spring means may also be a mechanism which performs similarly such as elastic cords, or a mechanism which will perform the desired biasing function. Possibilities are a motor drive with a slipping clutch and a fluid cylinder with a pump.

The spring means can also be attached to the movable frame member instead of the lower pivot arm or offset extension of the lower pivot arm. But such a design will lack the automatic locking feature explained above for the fully extended position of the movable frame member. To overcome this problem, a mechanical catch can be added to the apparatus to lock the movable frame member in an extended position. The most preferred location for a catch release is in a handle employed by a customer or user to pull the movable frame down. In a variation, the spring means can also be attached to an offset extension of the movable frame member, which if long enough and positioned properly, would provide the automatic locking feature provided by the embodiment using the offset pivot arm extension.

Although the fixed support, movable frame member and pivot means may be built in various shapes, they are preferably rectangular. They may be constructed of angle iron, sheet metal, expanded metal, mesh, plastic, or any other material or combination of materials deemed appropriate.

The upper and lower pivot arms may assume various shapes. The preferred pivot arms are rectangular and comprised of rods. One of the rods from each pivot arm is pivotally coupled with the fixed support, and another of said rods from each pivot arm is pivotally coupled with the movable frame member.

It is desirable for a dampening means to be interconnected between the movable frame and the fixed support for dampening the motion of the movable frame in either an upward or downward direction, especially the upward direction of the movable frame from the second position to the first position. In the most preferred embodiment, a spring means aids in dampening motion of the member in a downward direction.

The dampening means may be attached to the movable frame member or a portion of the pivot means such as the lower pivot arm. The means may be hydraulic, pneumatic or spring. A common air cylinder door closer serves well. One design of door closer offers little resistance in the opening direction by opening a flapper valve to the air chamber allowing air to easily escape. But the closing direction is cushioned by air in the air chamber and a closed flapper valve.

In addition to varying the tension of the spring means or changing the spring means, a counterweight system may also be employed with the movable frame to offset at least a portion of the weight of things placed on the movable frame member. The counterweight system of the invention comprises a pulley mounted to the fixed support relatively near a top of the fixed support, a counterweight, and a cord passing over the pulley having two ends. One end of the cord is preferably attached to the upper pivot arm relatively near the movable frame member or the movable frame member itself, and the other end is attached to the counterweight. The counterweight is located below the pulley such that the counterweight pulls on the upper pivot arm and movable frame member through the cord to help bias the movable frame member in its retracted position.

Other variations of the movable frame invention aid in hiding the operating parts of the movable frame and provide convenient and highly visible advertising signage.

One embodiment involves using a retractable device similar to a window shade between the top of the fixed support and the top of the movable frame member. A pop-up sign on top of the movable frame member is a second variation.

The retractable device may be comprised of a cylinder mounted to a fixed support relatively near a top of the fixed support, and a flexible screen having two ends. One end of the screen is attached to the cylinder and the opposite end is attached to the movable frame member relatively near a top of the movable frame. The screen is retracted around the cylinder when the movable frame member is in its retracted position, and the screen is stretched between the fixed support and the movable frame member when the movable frame member is in its extended position.

The pop-up sign embodiment is comprised of a pop-up sign pivotally coupled to the movable frame member, relatively near a top of the movable frame member, and a means for pivoting the pop-up sign between retracted and extended positions. The pop-up sign remains in a retracted position between the movable frame member and the fixed support when the movable frame member is in its retracted position, and pivots to an extended position above the movable frame member when the movable frame member has moved outwardly and downwardly from its retracted position.

The movable frame may also comprise a support means attached to the movable frame member for supporting objects placed on the support means. The support means may be a peg board, shelves, cups, troughs, or other suitable means mounted on the movable frame member to display products thereon. The support means may be a facing mounted parallel or perpendicular to the fixed support and movable frame member. Shelves may be attached to be loaded with products from the side or the front.

A handle means is preferably attached to the movable frame relatively near a bottom thereof to aid in moving the movable frame down to this extended position and back to its retracted position. The handle means is particularly important in a retail store to provide a convenient and obvious manner of using the pull down apparatus. It may also be desirable to hang a length of cord from a handle means to aid disabled persons and wheelchair customers in using the pull down apparatus.

The instant invention also includes a method for moving products from an initial raised position to a final lower position, the method including pulling down on a movable frame as described herein. Preferably, the method includes pulling down and out on the movable frame until the movable frame reaches its extended downward position.

Reference to FIGS. 1-5 will help illustrate the invention of the movable frame and pull down apparatus. The fixed support is indicated generally at 10 and the movable frame member at 11. Upper pivot arm 12 is comprised of rods 13, 14, 15, 16, and 17. Lower pivot arm 20 is comprised of rods 21, 22, 23, 24 and an unseen rod hidden behind horizontal slat 13 of the movable frame member 11.

Rod 14 of the upper pivot arm 12 is attached to the fixed support 10 at bushings 25 and 26 which serve as pivotal couplings. Rod 16 of the upper pivot arm 12 is attached to the movable frame member 11 at bushings 27 and 28 which serve as pivotal couplings.

Rod 22 of the lower pivot arm 20 is attached to the fixed support 10 at bushings 29 and 30 which serve as pivotal couplings. The lower pivot arm 20 is attached to the movable frame member 11 at bushing 31 and an unseen bushing hidden behind horizontal slat 13 of the movable frame member 11.

Depending upon the method of constructing the apparatus, it may be desirable to ensure rods 14, 16, 22 and 35 do not slip out of their bushings in the fixed support 10 and movable frame member 11. One possible solution is to place collars, washers, nuts, or similar means on the rods at a strategic place to stop the rods from moving relative to their bushings. Another solution is to place drive-on cap nuts at the ends of rods.

Horizontal rod 35 is attached to the fixed support 10 at points 36 and 37. Springs 33 and 34 are attached to horizontal rod 35 at points 38 and 39. The other ends of springs 33 and 34 are attached to rod 40, the offset pivot arm extension, at points 43 and 44. Offset rod 40 is attached to the lower pivot arm 20 with brackets 41 and 42, attached to rods 23 and 21, respectively. Air cylinder dampening means 48 is attached to the fixed support 10 and rod 24 of the lower pivot arm 20. Part of the movable frame member 11 itself, such as slat 13, may provide the support means for supporting products thereon. Alternatively, an additional facing such as peg board may be hung on the movable frame member 11. A sign member 70 is movably secured about the bushings 27 and 28 and a bar 72 contacts and extends between the rods 13 and 15 so that, as shown in FIG. 5, as the frame member 11 moves out and down, the sign member 70 becomes erect.

Figure 2:
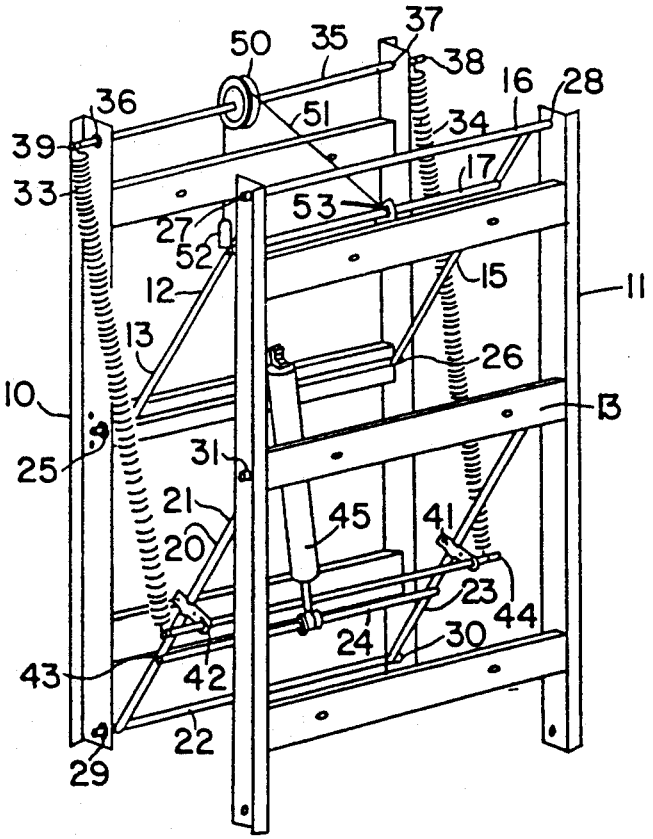
FIG. 2 is an isometric drawing of a pull down display and storage apparatus according to this invention having a counterweight system to handle heavier loads.

FIG. 2 illustrates the counterweight embodiment added to the apparatus of FIG. 1 to help in handling heavier product loads on the movable frame member 11. Pulley 50 is rotatably mounted on horizontal rod 35. Cord 51 passes over the pulley 50 with one end attached to rod 17 of the upper pivot arm 12 at point of attachment 53. The other end of the cord 51 is attached to counterweight 52 hanging below pulley 50. The cord may be as long as is needed and desired.

Figure 3:
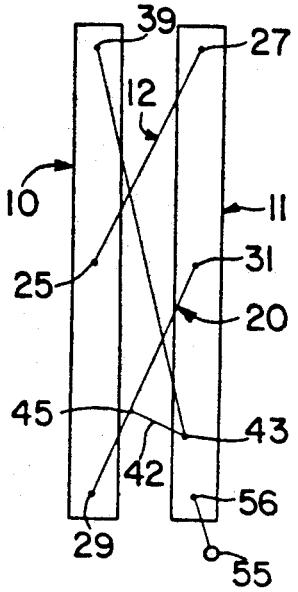
FIG. 3 is a simplified block diagram of one preferred apparatus according to this invention in a retracted position.
Figure 4:
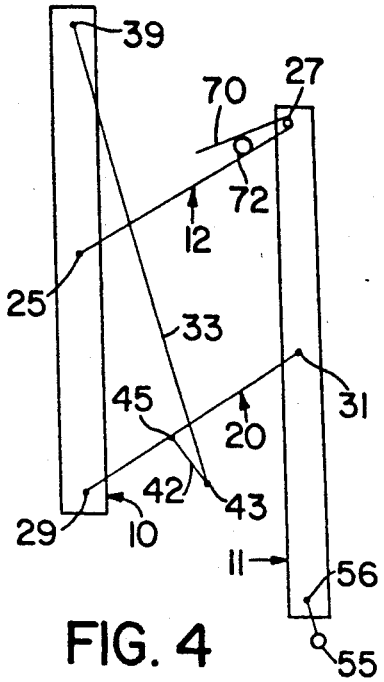
FIG. 4 is a simplified block diagram of the apparatus of FIG. 3 in a partially extended position.
Figure 5:
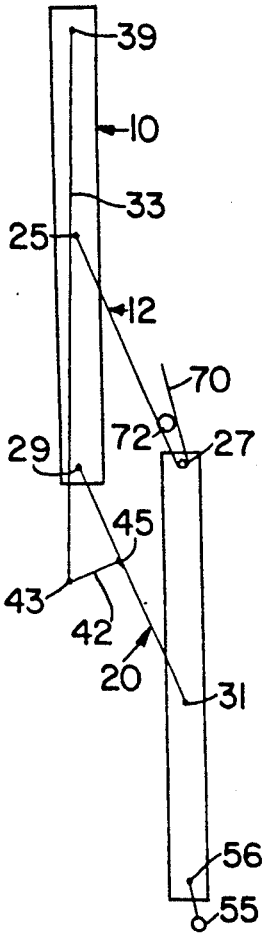
FIG. 5 is a simplified block diagram of the apparatus of FIG. 3 in a fully extended position.

FIGS. 3, 4, and 5 illustrate the automatic locking feature provided by the offset pivot arm extension. FIG. 3 shows the movable frame member 11 in a retracted position adjacent the fixed support 10. In FIG. 4, there has been a downward pull on handle 55 attached to movable frame member 11 at point of attachment 56. If the handle 55 is released in this movable frame position, the spring tension should be sufficient to overcome the pull of gravity and return the movable frame member 11 to its retracted position adjacent the fixed support 10. Note that the point of attachment 43 of the spring 33 to the offset pivot arm extension, shown here as bracket 42 attached to lower pivot arm 20 at point 45, lies between point of attachment 29 and the movable frame member 11.

FIG. 5 illustrates the fully extended, automatically locked position of movable frame member 11 below the fixed support 10. In this position, the lower pivot arm 20 is located between point of attachment 43 to the offset pivot arm extension and the movable frame member 11. Although spring 33 is stretched to its highest tension level, spring 33 is powerless to raise the movable frame member 11. Instead, spring 33 urges the movable frame member in a downward direction closer to the fixed support 10 since the point of attachment 43 has passed the vertical alignment position formed by points 29, 25 and 39.

It may be desirable to place a stop means on the apparatus to interact between the fixed support 10 or movable frame member 11 and a pivot arm 12 or 20 to stop the downward travel of the movable frame member 11 at a desired position. The stop should be positioned to prevent the movable frame member 11 from banging into objects below the apparatus.

Movable frame member 11 will remain in this fully extended position until handle 55 is pulled outward, moving attachment point 43 past the vertical alignment position. Once point 43 passes the vertical alignment position, the spring 33 will automatically pull movable frame member 11 back up to this retracted position adjacent the fixed support 10.

Figure 6:
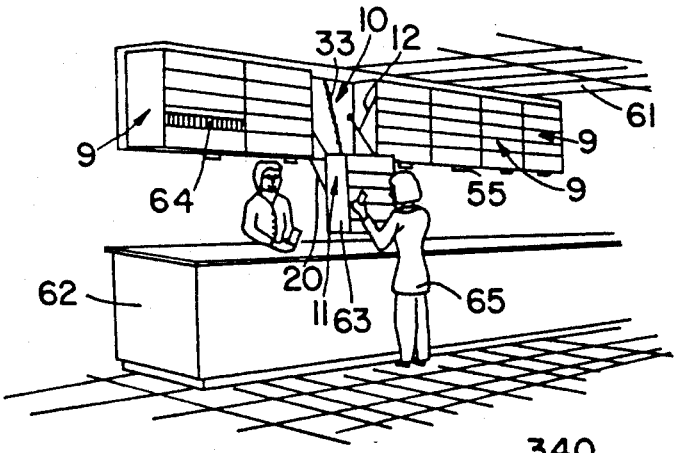
FIG. 6 is a perspective drawing of multiple apparatus according to this invention hanging from the ceiling above a retail sales counter.

FIG. 6 illustrates multiple pull down and display apparatus 9 hanging from a ceiling 61 above a retail sales counter 62. The seven apparatuses 9 displaying video tapes 64 are comprised of movable frame members 11 hanging from a fixed support 10 by upper pivot arms 12 and lower pivot arms 20. Spring 33 is visible above the movable frame member 11. Support means 63 is attached to the movable frame member 11 for supporting the video tapes 64. The shopper 65 used a handle such as 55 to pull the movable frame member 11 and support means 63 down to reach a video tape 64.

Figure 8:
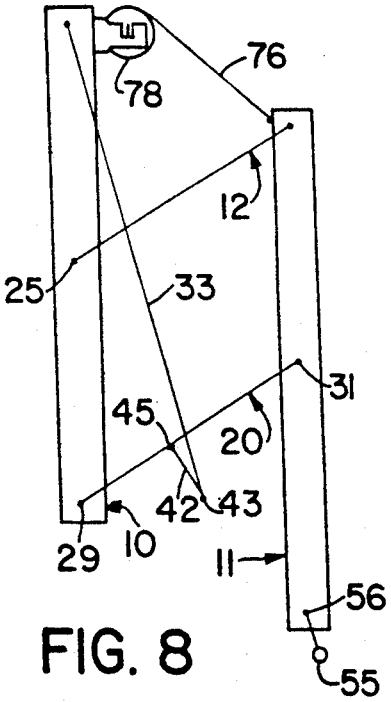
FIG. 8 is a side view of a pull down display according to the present invention.
Figure 9:
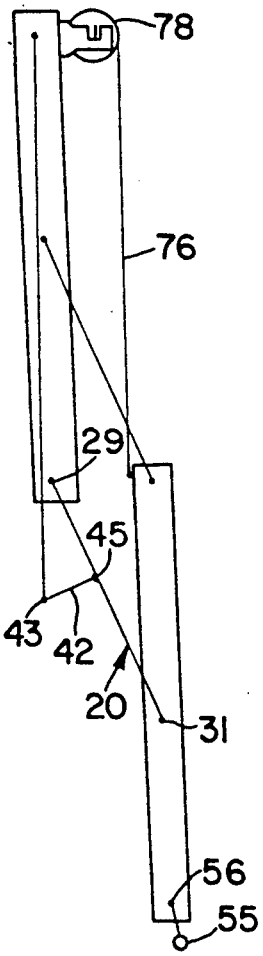
FIG. 9 is a side view of the pull down display of FIG. 8.
Figure 7:
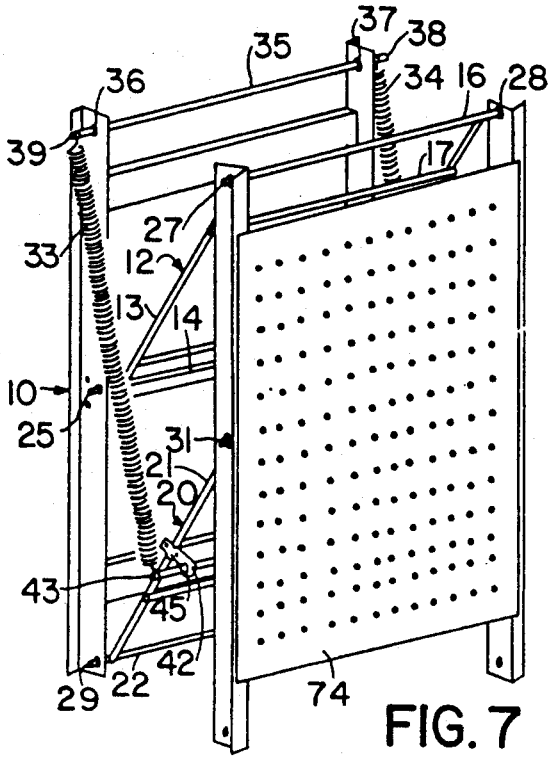
FIG. 7 is an isometric drawing of a pull down display according to the present invention.

FIG. 7 shows a peg board 74 affixed to the frame member 11 of the device shown in FIG. 1. FIGS. 8 and 9 show a retractable flexible screen 76 attached to a retracting cylinder 78 at one end and to the movable frame 11 at the other end. As shown in FIG. 9, the screen has been pulled from the cylinder 78 upon outward/downward movement of the frame member 11.

Referring now to FIGS. 10*a* and 10*b*, a pull-down display 90 according to the present invention (like the apparatus shown in FIGS. 1 and 3) is in an upright position on top of a support such as a refrigerator 92 with a door 94 and a front wall 96. Shelves 98 secured to a movable member 100 of the display 90 have a front member 102 which is tilted slightly outwardly so that goods disposed thereon may be seen more easily by the person P. For example, in a typical situation, the item 104 would be about nine feet above the floor, but the person P can see the item easily due to the tilt of front member 104. This tilting disposition of the items can also be adjusted to reduce glare from lighting above or adjacent the display 90. As shown in FIG. 10*b*, the person P can access all the items on the display 90 with ease once the display 90 has been moved downwardly, by pulling on an extension 106 of the movable member 100. By pulling out slightly on the display as shown in FIG. 10*b*, it will return to its position as shown in FIG. 10*a*. While the display is in the position shown in FIG. 10*a*, the door 94 may be opened without contacting the display 90. (For simplification, the springs, etc. of the display 90, like those shown in FIG. 1 for controlling movement of the movable member, are not shown in FIGS. 10*a* and 10*b*).

FIGS. 11*a* and 11*b* illustrate a retractable screen or paper 108 and its connection to the display 90. A retracting cylinder 112 (e.g. as used with well-known retractable window shades) is secured to a fixed member 110 of the display 90 which is secured to the wall 96. The screen 108 is secured to the cylinder 112 so that upon outward and downward movement of the movable member 100, the screen 108 is pulled from around the cylinder 112. The screen is secured in a channel 114 attached to the movable member 100 by a rod 116 which fits snugly in the channel 114 with the screen 108. Upon upward movement of the movable member 100, the screen 108 is retracted onto the cylinder 112. There are no pawls or other stop members in the cylinder 112 (as there are in some well-known window shades), so there is always an upward pull on the screen 108.

FIGS. 12*a*, 12*b*, 12*c*, 13, 14 and 15 illustrate a device 12 according to the present invention (like the pull down displays shown in FIGS. 1, 4 and 7, but without showing the springs, etc. of the device 120 which provide for controlled movement of its movable member. The springs, etc. are represented by the dotted line in FIGS. 12*a*, 12*b* and 12*c*.) The device 120 has a fixed member 122 secured to a top shelf 124 of a plural series of shelves 126. Pivot arms 128 and 130 (and two corresponding arms on the other side of the device which are not shown) render movable member 132 movable with respect to the fixed member 122. A sign panel 134 lays on the arm 130 and, when the movable member 132 is in the upright position shown in FIG. 12*a*, the sign panel 134 is disposed between the fixed and movable members. If the movable member 132 is opaque, then the sign panel 134 cannot be seen in the position shown in FIG. 12*a*. If the movable member 132 is transparent, then a side of the sign panel 134 is visible when the movable member 132 is in the upright position.

FIG. 12*b* illustrates the movement of the sign panel 134 with the movable member 132 as the movable member 132 is moved outwardly and downwardly from the upright position of FIG. 12*a*. FIG. 12*c* shows the sign panel 134 tilted slightly forward and held in position by a bracket 140 secured to the sign panel 134 and around the arm 130 when the movable member 132 is in a down position.

FIGS. 13, 14 and 15 show in detail how the bracket 140 coacts with the arm 130 to position and control the sign panel 134. The sign panel 134 is movably mounted on a rod 136, e.g. by one or more brackets 142, and the rod 136 is disposed in upright support members 138 (one shown) of the movable member 132. Slight momentum of the sign panel 134 will move it into the tilted position shown in FIG. 15 near the end of the downward travel of the movable member 132.

FIGS. 17*a*, 17*b* and 17*c* illustrate a pull-down display device 150 according to the present invention which has a movable member 152 movably connected to a fixed member 154 (which may or may not be part of the device 150). A spring (or springs) represented by a dotted line 156 extends between a point 158 on the fixed member 154 and a point 160 on a pivot arm 162 that interconnects the fixed and movable members, as does another pivot arm 164.

FIGS. 17*a*–*c* show a simplified series of operation of the device 150. It is desirable in this embodiment that the movable member 152 come to rest either all the way up or all the way down, i.e., not in any intermediate position without being physically held there. This feature is accomplished by the arrangement of angles and connections of the various members. With the movable member 152 in the up position (FIG. 17*a*) spring 150 can pull between point 158 at the top and point 160 on the arm 162 to maintain the movable member 152 in the up position. In FIG. 17*b*, the spring 156 is still attempting to pull the movable member 152 upward if the movable member 152 is released. At this point, a load on the movable member 152 can be balanced with adjustment on the spring 156 so that the movable member 152 is being pulled upward only with a very light pressure if the movable member 152 is released. An air cylinder (not shown) can prevent fast upward movement with very little effort because of this balanced condition (see air cylinder 45, FIG. 2).

In FIG. 17*c*, the movable member 152 is all the way down, and because of the position of point 160 where the spring is anchored on the moving arm 162, and the upper anchor point 158 of the upper end of the spring, point 160 has passed "dead center" and the spring is now unable to pull the movable member 152 back to the upright position. The movable member 152 is thus releasably locked in place due to the action of the spring. Thus the movable member 152 will remain in the full down position until it is pulled outward slightly. Once the "dead center" point has been passed going outward, the spring 156 will start to pull the movable member 152 upward to its full up position once again.

A cord 164 with a ball 166 attached to it facilitates access to the device 150 and movement of the movable member 152. The cord's length can be adjusted to accommodate persons of various heights or to make access possible to those in wheelchairs. The device 150 is positioned on a shelf 168 of a series of shelves 169.

FIGS. 18*a* and 18*b* illustrate a pull-down display device 170 according to the present invention which is like the device 150, but has a flexible panel 172 which is exposed upon outward and downward movement of a movable member 174 movably connected to a fixed member 176. The fixed member 176 is secured, e.g. with a support member 178, to a shelf 180 of a series of shelves 182 that are secured on a wall 184. The flexible panel 182 is secured to the top of the movable member 174 and passes over a tube 185 on the top of the fixed member 176 and over a member 186 attached to the fixed member 176. A weight 188 (e.g. a rod or tube) is attached across the end of the flexible panel 172. The weight holds the flexible panel member taut when it is exposed and provides weight to facilitate retraction of the flexible panel behind the fixed member 176 as the movable member 174 is moved upwardly.

Referring now to FIG. 16, a pull-down display 200 according to the present invention has a movable member 204 movably connected to a fixed member 202 by a lower pivot member 224 and an upper pivot member 225. The lower pivot member 224 has three cross rods 218, 220 and 222 interconnected with pivot arms 214 and 216. The upper pivot member 225 has two cross rods 210 and 212 interconnected with two pivot arms 205 and 208. At points T, there is an angle less than 180 degrees in the pivot arms 214 and 216.

The fixed member 202 has a top cross bar 258, upright members 260 and a bottom cross bar 262. The movable member 204 has upright members 264, bottom extensions 256, and a cross support 252.

Interconnected between the top cross bar 258 of the fixed member 202 and the cross rod 222 of the pivot member 224 are three springs 226, 228 and 230 and an air cylinder 238. The springs 226, 228, 230 are each connected to a metal strip 232, 234, and 236, respectively; and the strips are secured to the rod 222 by securements 242, 246, and 244, respectively. The air cylinder 238 is secured to the rod 222 by a connector 240.

The apparatus 200 is secured to a shelf 250 by braces 248 extending from the shelf 250 to the upright members 260 of the fixed member 202.

It is preferred that the spring 230 be used and adjusted to lift and control the device 200 and that the springs 226 and 228 be used and adjusted to provide lift for items displayed on the device 200. The air cylinder 238 prevents the movable member 204 from returning upward too quickly and provides for gentle movement of the movable member 204. A series of holes 266 in the metal strips 232, 234, and 236 provides adjustability in the tension of the springs 226, 228 and 230. It is preferred that a portion of the metal strips extend into the springs for easy one-hand adjustment of the springs.

FIG. 19 shows the device 200 of FIG. 16 with a series of trays 205 attached to the movable member 204 and an exposable paper sign 207 which is interconnected between the movable member 204 and the fixed member 202. The sign 207, if opaque, will conceal the mechanism behind it when it is in the pulled-down position. Items 209 for sale, storage, or display can be placed in the trays 205.

FIG. 20 shows in detail the mechanism of the sign 207. The sign is connected at one end to the top of the fixed member 202 and at the other end to the top of the movable member 204. A weight rod 243 is disposed in a loop 247 in the sign 207. As shown in FIG. 24, rims 245 on the rod 243 help to maintain it in position in the loop 247. FIG. 21 shows the connection of the sign 207 to the top of the fixed member 202 by means of a channel 235 and a tube 237 that fits snugly in the channel with a portion of the sign to secure it in place. FIG. 23 shows a similar securement of the other end of the sign to the movable member 204 with a channel 255 and a tube 257. FIG. 22 shows a tube 267 disposed on the upright members 204 of the movable member 204 to insure easy passage of the sign over the first upright member 265.

As shown in FIGS. 19 and 20, the movable member 204 has additional upright members 253 (one shown in FIG. 20) to which are connected the trays 205. The upright members 253 are interconnected with the upright members 264 by spacers 277. The sign 207 moves down between the upright members 264 and 253 as the movable member 204 moves upwardly.

Figure 26:
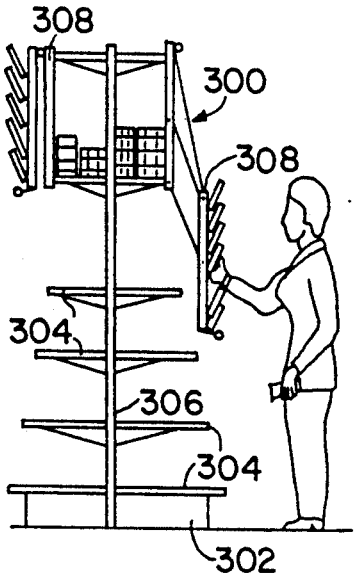
FIG. 26 is a side view of a pedestal according to the present invention.

FIGS. 26 shows device 300 according to the present invention which includes a pedestal 302, shelves 304 connected to the pedestal, an upright portion of the pedestal 306, and two pull-down display devices 308 (like the devices previously described). Depending on the size of the device 300, one or more pull down display devices may be employed.

Figure 25:
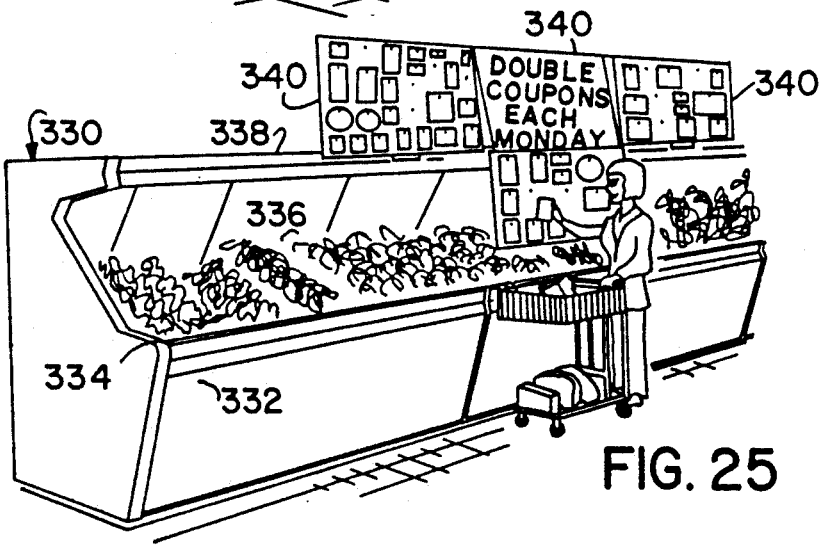
FIG. 25 is a perspective view of a case according to the present invention.

FIG. 25 shows a merchandise or food case 330 according to the present invention with a main body 332, a shelf 334 for supporting merchandise or food 336, a top 338 of the main body, and a plurality of pull-down displays 340 according to the present invention secured to the top 338.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention. In conclusions, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. A movable frame for connection to and movement outwardly and downwardly with respect to a fixed support, the movable frame comprising:

a) a movable frame member;

b) pivot means interconnected between the movable frame member and the fixed support for pivoting movement of the movable frame member from a first higher position adjacent the fixed support to a second lower position spaced outwardly from and downwardly with respect to the fixed support, the movable frame member defining a plane that is generally vertically positioned in the lower position;

c) spring means interconnected between the movable frame member and the pivot means, the spring means pulling the movable frame member upward and toward the fixed support as the movable frame member moves; and d) adjustment means to change the tension of the spring means; and e) the spring means disposed so that the movable member is movable downwardly and outwardly from a first position to a second position and then inwardly to a third position beyond a center line from a point of connection between the fixed support and the pivot means, the spring means then pulling inwardly on the movable frame member to releasably lock the movable frame position to a second position and then inwardly to a third position beyond a center line from a point of connection between the fixed support and the pivot means, the spring means then pulling inwardly on the movable frame member to releasably lock the movable frame member in the third position.

2. The movable frame of claim 1 wherein the spring means is adjusted to provide a balanced movement of the movable frame member.

3. The movable frame of claim 1 wherein the spring means is adjusted to provide a balanced movement of the movable frame member and a load thereon.

4. The movable frame of claim 1 including adjustment means to change the tension of the spring means, and the spring means disposed and adjusted so that the movable frame member will not stop at any position other than the first or third position.

* * * * *